United States Patent [19]

Maspero

[11] 4,385,712

[45] May 31, 1983

[54] AUTOMATICALLY AND SEMIAUTOMATICALLY UNJAMMING NAIL SELECTION DEVICE, DESIGNED PARTICULARLY FOR MACHINES RIVETING FOOTWEAR HEEL SEATS ONTO CORRESPONDING HEELS

[75] Inventor: Carlo Maspero, Como, Italy

[73] Assignee: Camoga S.a.S. di Mascetti Attilio & C., Milan, Italy

[21] Appl. No.: 187,989

[22] Filed: Sep. 17, 1980

[30] Foreign Application Priority Data

Sep. 20, 1979 [IT] Italy ..... 25892 A/79

[51] Int. Cl.[3] ..... G07F 11/00

[52] U.S. Cl. ..... 221/13; 221/93; 221/171; 221/292

[58] Field of Search ..... 221/13, 160–162, 221/167, 169, 170, 276, 292, 293, 296, 299, 300, 93, 171; 227/121

[56] References Cited

U.S. PATENT DOCUMENTS

| | | | |
|---|---|---|---|
| 1,191,180 | 7/1916 | Havenet | 221/169 |
| 2,433,560 | 12/1947 | Hufley | 221/13 |
| 3,061,147 | 10/1962 | Viltterding | 221/296 |

FOREIGN PATENT DOCUMENTS

| | | | |
|---|---|---|---|
| 1068048 | 5/1967 | United Kingdom | 221/299 |

*Primary Examiner*—H. Grant Skaggs

*Attorney, Agent, or Firm*—Fleit, Jacobson & Cohn

[57] ABSTRACT

An automatically and semiautomatically unjamming nail selection device, designed particularly for machines riveting footwear heel seats onto corresponding heels. The device has a nail tank or magazine coupled with a rotary chamber equipped with units designed to lift the nails and drop them onto a chute having a number of raceways which join with corresponding guides leading to a mobile combshaped selector moving to-and-fro in a perpendicular direction relative to the nail feed direction. The selector is designed to select such nails and deliver them to a distributor moving to-and-fro parallel to the selector and having feeding ducts leading to the utilization outlet. The selector is integral with an arm controlled by a first fluid dynamic actuator which determines its to-and-fro elastic motion, and the distributor is connected—through a rigid coupling—to another arm which is, in turn, shifted elastically to-and-fro by a further fluid dynamic actuator. The first fluid dynamic actuator is interlocked to an automatic unjamming pilot system, designed to produce some slight oscillation in the selector whenever the same jams up, and to another pilot system for the semiautomatic unjamming of the selector, this second system controlling the selector's motion back to its resting position whenever the jamming of the same is not cleared by the automatic unjamming device.

11 Claims, 22 Drawing Figures

RESET
35
6
8
9
9a
9b

AUTOMATICALLY AND SEMIAUTOMATICALLY UNJAMMING NAIL SELECTION DEVICE, DESIGNED PARTICULARLY FOR MACHINES RIVETING FOOTWEAR HEEL SEATS ONTO CORRESPONDING HEELS

SUMMARY OF THE INVENTION

This invention relates to an automatically and semiautomatically unjamming nail selection device, designed particularly for machines riveting footwear heel seats onto corresponding heels, comprising a nail tank or magazine coupled with a rotary chamber equipped with units designed to lift the nails and drop them onto a chute having a number of raceways which join within corresponding guides leading to a mobile comb-shaped selector moving to-and-fro according to a perpendicular direction relative to the nail feed direction, designed to select such nails and deliver them to a to-and-fro moving distributor parallel to the selector and feeding the ducts leading to the utilization outlet.

It is known that the fitting of heel seats onto corresponding footwear heels can be accomplished either through glueing or through riveting. When the machines employed for such task—called "heel seat fitting" machines—are preset for the riveting operation, same are supplied with an apparatus comprising a nail container, which is generally made up of a fixed portion and a rotary portion, the latter being controlled by a geared motor which keeps it rotating continuously. Such rotary portion is, basically, bell-shaped and is equipped with a number of tongues by means of which the nails, randomly placed on the bottom of the container, are lifted and dropped onto the raceways of a chute, which is integral with the fixed portion of the container. Said raceways lead to some guides produced in the fixed part of the apparatus and designed to feed a selector unit. In order to prevent the formation of overlapping groups of nails at the mouth of the guides, hence to prevent any interruption in the following nail feed, the inside of the fixed portion of the container is equipped with a blade rotor, such blades being designed to keep the raceways area clear, dropping all excess nails onto the bottom of the container.

The selector unit is composed of a basically comb-shaped plate endowed with a to-and-fro reciprocating motion. The teeth of the selector unit are arranged obliquely and delimit a number of spaces, each of which leads into a through hole.

As the above mentioned plate moves to-and-fro, said holes overlap with an equal number of corresponding holes produced in a block which is integral with the nail guides. Just below said block, the apparatus presents a distributor which is endowed with twice as many through holes as the selector unit.

Also the distributor is subjected to a to-and-fro reciprocating motion, which is parallel to that of the selector unit, but its motion is controlled in such a way that two forward and backward strokes of selector correspond to a single forward and backward stroke of the distributor. The movements of the selector unit and of the distributor are synchronized so as to allow the feeding of all the distributor holes since the latter has twice as many holes as the selector.

In accordance with known technology, such to-and-fro movements are transmitted to the selector unit and to the distributor through complex gear and cam mechanisms which, in turn, are operated by the actuator which causes the container bell to rotate.

The main drawbacks inherent in these known apparatuses become apparent as soon as the selector unit inevitably jams, due to the presence of faulty nails, and such jam up blocks the nail feed to the heel seat fitting machine. Presently, the unjamming of the nail selection device must be executed manually by the operator, who can do this in various ways. A common adopted method of unjamming the machine consists of hitting the selection device with a tool or else using a screwdriver or pliers for the direct extraction of the faulty nail. Each of these methods, however, entails the tampering of the machine which in turn leads to an early deterioration of the vairous components and makes future jam ups progressively more probable. The main problem underlying this invention is that of producing a nail selection device which makes it possible, whenever jamming occurs, to do away with the operator's direct manual action, thus providing the machine with an automatic or semiautomatic unjamming device.

A further problem pertaining to the nail selection device according to this invention is that of making the to-and-fro motion of the selector unit and of the distributor independent of the actuator controlling the nail container rotary bell.

The above problems, and others still which may possibly become apparent in the course of the following description, are solved, according to this invention, by a nail selection device capable of unjamming automatically and semiautomatically, designed particularly for machines riveting footwear heel seats onto corresponding heels, which is characterized by the fact that said selector is integral with an arm operated by a first fluid dynamic actuator which determines its to-and-fro elastic motion, and said distributor is connected—through a rigid coupling—to another arm which is shifted elastically to-and-fro by a second fluid dynamic actuator, the former fluid dynamic actuator being interlocked to a first automatic unjamming pilot system, designed to produce some slight oscillation in the selector whenever same jams up, and to a further pilot system for the semiautomatic unjamming of the selector, the latter system being designed to control the selector's motion back to its resting position whenever the jamming of same is not cleared by the automatic unjamming device.

The advantages achieved through this nail selection device amount, basically, to the elimination of any possible damage to the machine caused by the operator.

Consequently, this entails a longer life and a greater degree of reliability for the machine itself, because the probability of jamming is reduced to a minimum.

Another feature which is to be noted is that both with the automatic and with the semiautomatic unjamming device, the machine stops for a very short time only, hence the possibility to increase the machine's productivity.

BRIEF DESCRIPTION OF THE DRAWINGS

Further characteristics and advantages will appear more clearly in the detailed description of a preferred embodiment of a nail selection device, according to this invention, which is supplied hereunder with reference to the enclosed drawings, provided by way of example and by no means limiting the scope of the invention, where.

DESCRIPTION OF THE PREFERRED EMBODIMENTS

Figure 1:
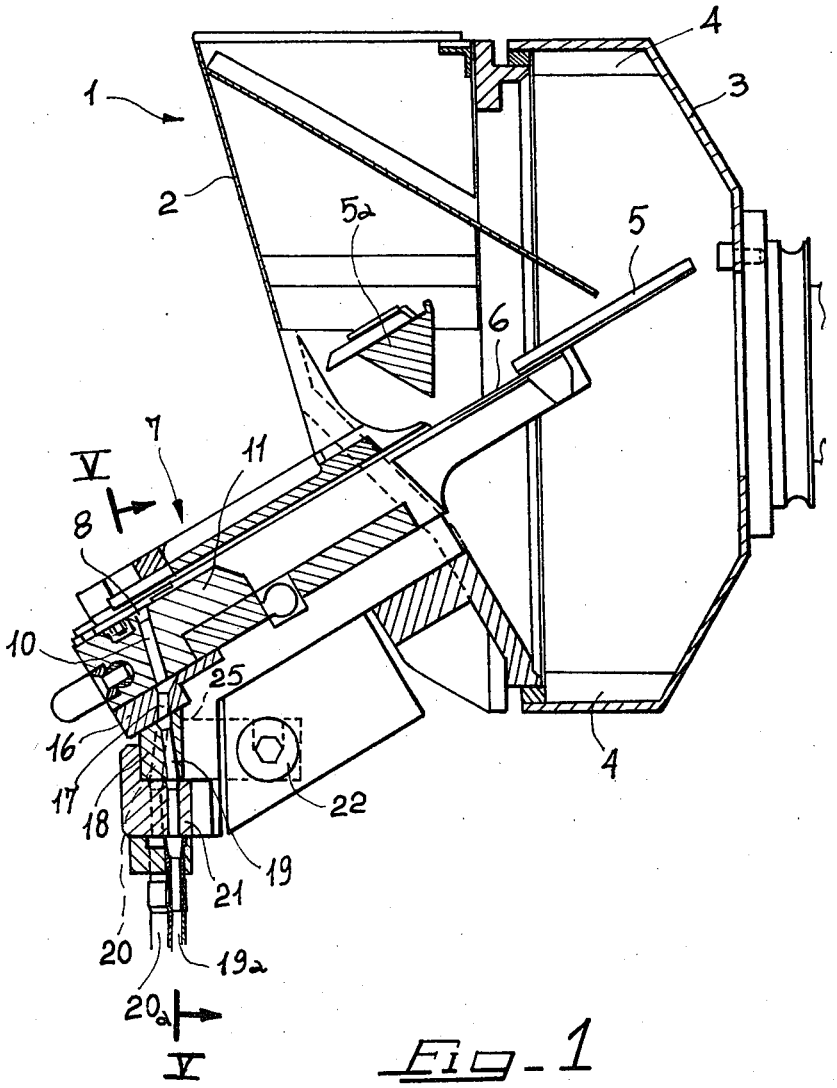
FIG. 1 gives a front elevation view of a cross section of the nail selection device.

With reference to said figures, and particularly to FIG. 1, "1" has been adopted to mark a nail magazine in its entirety, said unit being made up of a fixed portion 2 and a rotary portion 3, the latter being bell-shaped and kept constantly rotating by a geared motor (not shown in the figure). Rotary portion 3 is internally provided with a number of tongues 4 by means of which the nails—which are randomly placed on the bottom of the magazine—are lifted and dropped onto the raceways produced on chute 5, which is integral with fixed portion 2.

Figure 4:
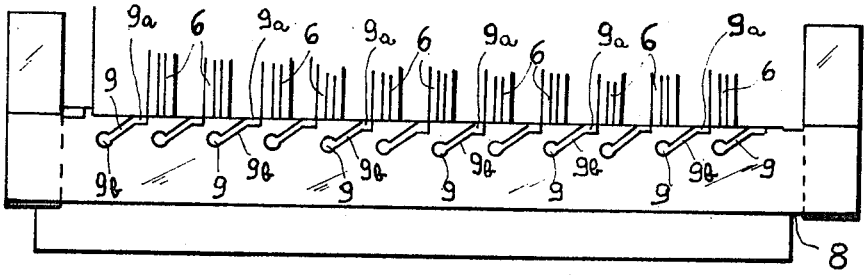
FIG. 4 gives a top view of the selector unit.

Said raceways of chute 5 terminate above just as many fixed, sloping guides 6, which are aligned parallel to one another with a constant pitch and designed to feed a selector unit set opposite block 7 which is integral with fixed portion 2 and protruding downwardly with respect to same. In order to prevent the nails from bunching, the design provides for a rotor 5*a*, equipped with a blade which rotates above guides 6. The above selector unit comprises a comb-shaped selector 8 made up of an elongated plate which is fitted having its axis perpendicular to the nail feed direction and moving to-and-fro in the direction of the said axis. Selector 8 is endowed with a number of sloping slots (FIGS. 4, 7, 8) which on the one side present a mouth expansion 9*a* and on the other are connected to holes 9*b* respectively, which are designed to let the nail heads through, hence deliver the nails themselves through a number of passages 10 produced in a fixed plate 11, said plate being located under selector 8.

Slots 9 are spaced in a regular way, having a pitch equal to that of guides 6, and their number equals that of said guides (twelve in the example shown hereunder). When set in its resting position (FIG. 4), selector 8 is positioned in such a way as to shut off the nail feed, while when set in its limit stop position the selector ensures the alignment of guides 6 with mouth 9*a* of slots 9. Moreover, in the resting position, holes 9*b* are aligned both with guides 6—so as to relate to that part of same which extends under selector 8—and with the aforementioned passages 10.

Figure 2:
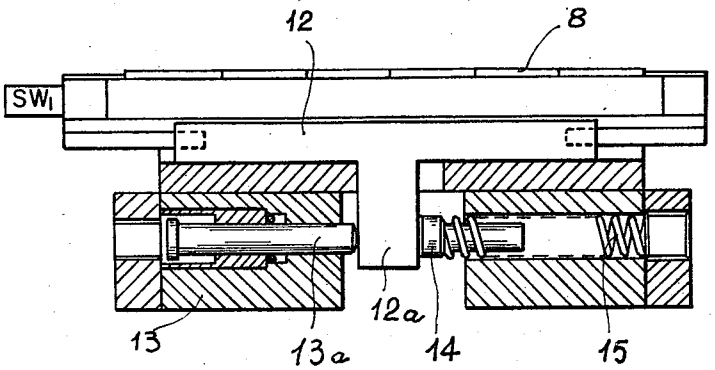
FIG. 2 gives a cross-selectional view of the actuator controlling the selector unit.

The to-and-fro motion of selector 8 is controlled by a fluid dynamic actuator. Looking at the matter in greater detail, as shown in FIG. 2, a rigid connection links selector 8 to a T-shaped support 12, which slides within corresponding guides. Switch $SW_1$ is positioned to sense the rest stop position of the selector 8 and to generate appropriate control signals.

The central portion 12*a* of support 12 is connected, at one end, to stem 13*a* of a single acting fluid dynamic cylinder 13, and, at the other end, to a piston 14 which is thrust toward said portion 12*a* by spring 15. The thrust of said spring is such as to oppose, to a certain extent, the pressure exerted by cylinder 13, in order to achieve the elastic shifting of the selector and to prevent same from exerting too much pressure on the nails, since this would eventually lead to the blanking or buckling of said nails in the event of jam ups.

Another fixed plate 16, equipped with respective passages 17 aligned with the aforementioned passages 10, is placed under plate 11. Said plate 16 is set above distributor 18, which is composed of an elongated prismatic body with a parallel axis to that of selector 8 and designed to move to-and-fro in the axial direction. Said prismatic body is supplied with two sets of passages 19, 20 (in the example illustrated hereunder, each by such sets is made up of twelve passages) which, in turn, are aligned with passages 17 depending on either of the distributor's limit stop positions.

Distributor 18 is, furthermore, integral with block 21, placed under the distributor and provided with internal ducts which are aligned with passages 19, 20; said block leads to flexible ducts 19*a*, 20*a* which are designed to convey the nails from selector 8 and distributor 18 to the units where they are finally utilized (not shown in figures). Said units are the ones generally to be found in machines designed to rivet footwear heel seats onto corresponding heels, which operate by means of a hydraulically controlled hammer, fitting the heel seat through the simultaneous driving in of a number of nails (e.g. twenty-three for men's footwear). In the example hereunder discussion, provision is made for twelve flexible ducts 19*a* and twelve flexible ducts 20*a*: should it, therefore, be necessary to fit twenty-three nails simultaneously, one of the aforementioned flexible ducts will not be utilized, or else will be set in such a way as to send nails passing through same to magazine.

Figure 3:
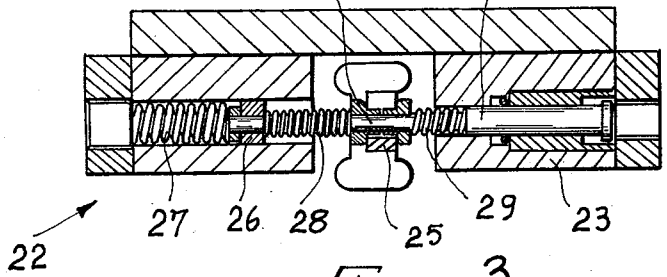
FIG. 3 gives a cross-sectional view of the actuator controlling the distributor.
Figure 5:
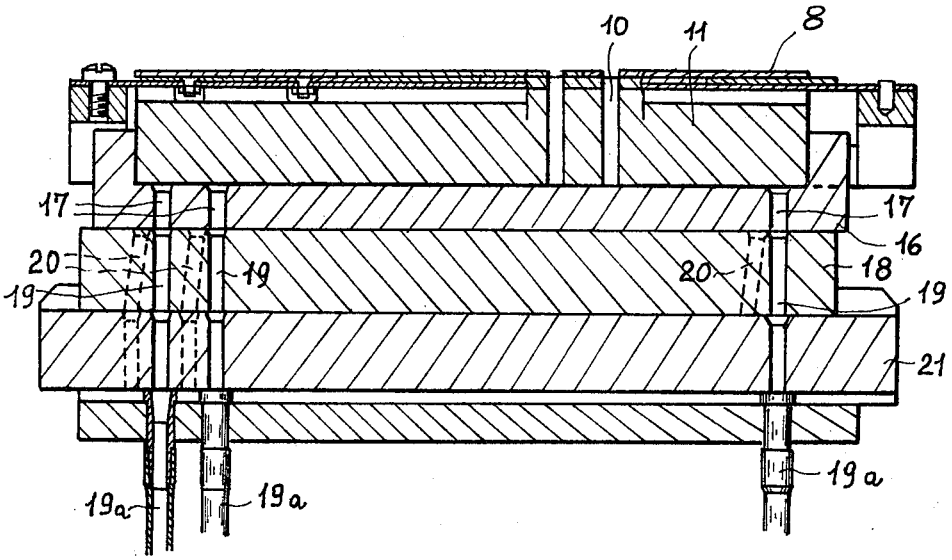
FIG. 5 shows a cross section executed along path V—V of FIG. 1.

Distributor 18 is shifted to-and-fro, parallel to the motion of selector 8, by means of its respective fluid dynamic actuator marked, in its entirety, by number 22 (FIGS. 1 and 3). Looking at the matter in greater detail, (FIG. 3), the design provides for a single-acting fluid dynamic cylinder 23, whose stem 23*a* extends in an axial direction with a rod 24 which goes through a hole produced in arm 25, the latter being housed in slot 40 and being integral with distributor 18.

The free end of rod 24 is connected to a piston 26 sliding in its respective seat and thrust toward cylinder 23 by a counter spring 27. Two spiral springs 28 and 29 are, furthermore, wound round rod 24, the former being located between piston 26 and arm 25 and the latter between arm 25 and stem 23*a*, so as to achieve a suitably sprung motion for distributor 18, hence preventing same from getting damaged in the event of jam ups.

Figure 6:
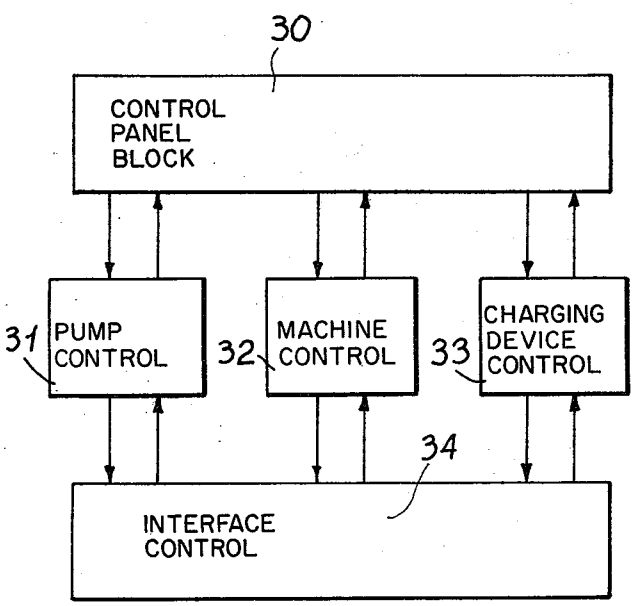
FIG. 6 is a block diagram of the circuit actuating the automatic and semiautomatic unjamming mechanism.

The motion of selector 8 and of distributor 18 is synchronized, so as to enable all the distributor's holes to be fed, since the distributor has twice as many holes as the selector. Hence, two forward and backward strokes of selector 8 correspond to a single forward and backward stroke of distributor 18. The device, according to the invention, is connected to an electrical-electronic system, a partial diagram of which is supplied in FIG. 6. In such diagram, 30 marks the control panel block; 31 indicates the control logic of the fluid dynamic circuit pump; 32 refers to the utilizing machine sequence logic; 33 marks the control logic of the nail charging device;

34 indicates the interface comprising the control solenoid valves, the limit switches and the thermal probes, designed to control the various mechanical components of the utilizing machine. As indicated in the diagram shown in FIG. 6, blocks 31, 32 are in contact both with block 30 and with block 34; moreover, block 32 is in contact with block 33, which means that the control logic of the charging device must be suitably correlated to the machine sequence logic.

The operative sequence of the device, according to this invention, can be easily followed with the aid of the operating diagrams shown in FIGS. 7a–7h and 8a–8g. Namely, the operative sequence shown in FIGS. 7a–7h refers to the automatic unjamming of the device, while the one shown in FIGS. 8a–8g refers to the semiautomatic unjamming operation.

Figures 7A, 7B, 7C, 7D, 7E, 7F, 7G, 7H, 8A, 8B, 8C, 8D, 8E, 8F, 8G:
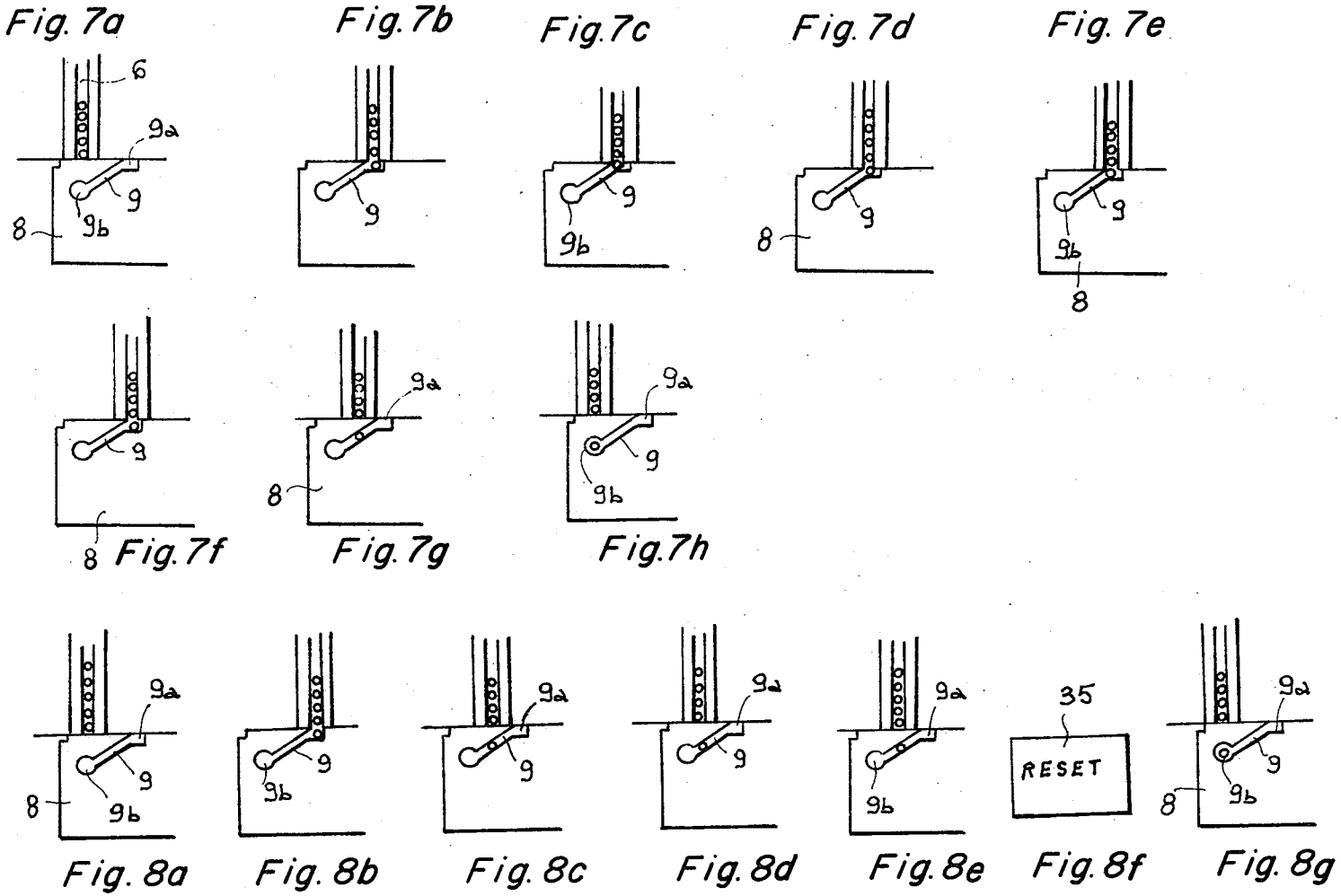
FIGS. 7*a*–7*h* illustrate schematically an operative sequence by which the automatic unjamming is effected.
FIGS. 8*a*–8*g* illustrate schematically an operative sequence by which the semiautomatic unjamming is effected.

With reference to FIG. 7a, the first diagram indicates the initial stage of a nail charging cycle, in which selector 8 is at rest switch $SW_1$, is closed, since the solenoid valve controlling cylinder 13 is deenergized (said resting position is determined by the thrust of spring 15 while cylinder 13 is connected to the discharge). In such position the nail feed supplied by guides 6 is obstructed by the top edge of selector 8. When the aforementioned solenoid valve is energized, cylinder 13 is fed and, therefore, selector 8 reaches the other limit stop position shown in FIG. 7-b, while a suitably adjusted timer is actuated so that the normal nail feed may take place within the pre-established time interval ($T_1$). This condition allows for the feeding of a nail into mouth 9a of sloping slot 9 relative to each of guides 6. When the limit stop position shown in FIG. 7-b is reached, also the solenoid valve is de-energized, hence the reverse phase of selector 8 is started due to the action of return spring 15. On the other hand, should a jam up occur at the height of any one of channels 6, all that happens is a slight backward shift, while selector 8 stops in the position shown in FIG. 7-c, because the nail which entered the mouth 9a at the end of the channel under discussion produces a mechanical shutdown (e.g., the nail under discussion may have too thick a head or else be, generally speaking, a faulty product). The stopping of selector 8 interrupts the operating cycle, and since said selector cannot be shifted back, also the limit stop sensor can't signal the attainment of the resting position. Some time after stoppage, the aforementioned timer transmits a signal to the control system indicating lapse of the pre-established time interval ($T_1$); said control system then, in response to such signal, starts the automatic unjamming operation. Such operation is carried out by setting selector 8 into a reciprocating motion until it returns to its normal working condition, such reciprocating motion being produced by the alternate energizing and de-energizing of the solenoid valve controlling cylinder 13. Thus, the arrangement shown in FIG. 7-c—which corresponds to a position in which selector 8 cannot effect its backward stroke—is followed by a phase in which the aforementioned solenoid valve is energized and the selector is shifted up to its forward stroke limit stop position (FIG. 7-d), after which the solenoid valve is de-energized and the selector is shifted to its resting position (due to the action of the return spring); however, should the jam up not be cleared, the selector cannot reach said position, hence stops (FIG. 7-e) once again in the same position it reached previously (as in FIG. 7-c). The solenoid valve is energized once more with the remaining accomplishment of the forward stroke (FIG. 7-f); then the solenoid valve is de-energized again. At this stage let us assume that the jam up has been cleared; the backward shift of the selector 8 can finally take place in a regular manner (FIGS. 7-g, 7-h) due to the action of return spring 15, while the nail causing the jam up is coupled, in the normal way, to its respective slot 9, passes through the corresponding hole 9b (FIG. 7-h), and reaches—due to the force of gravity—the utilization area through the flexible ducts.

This is how the automatic unjamming is achieved, which does not require any action on behalf of the operator.

Figure 9:
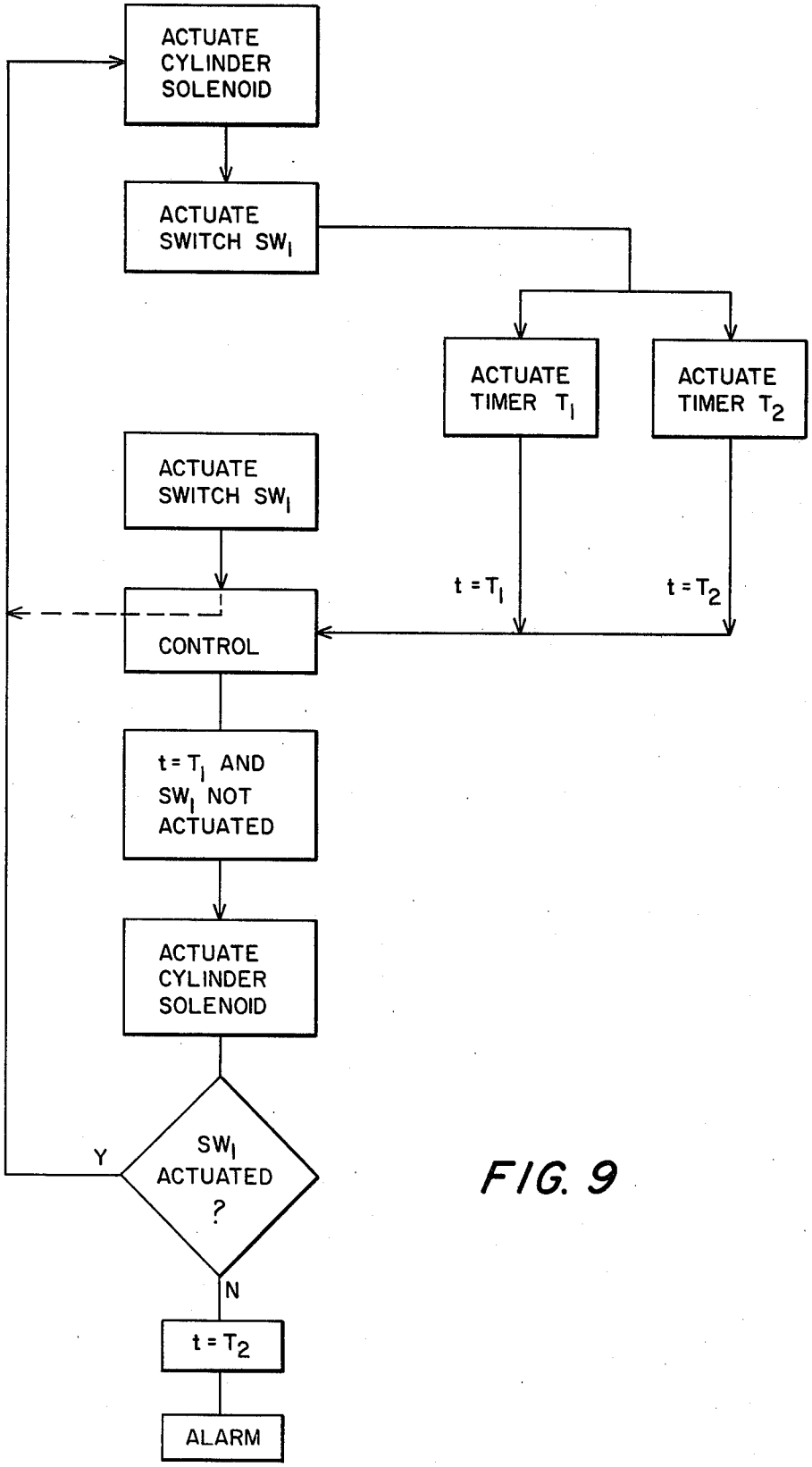
FIG. 9 schematically illustrates a flow diagram of the circuit of FIG. 6.

FIG. 9 schematically illustrates one embodiment of a flow diagram of control means or a control system of the present invention. Limit stop sensor or switch $SW_1$, which is associated with the rest position of selector 8, generates signals that actuate timing means, such as timers $T_1$ and $T_2$, when selector 8 starts its movement towards its forward limit stop position. The timers commence counting the lapsed time (t) of the operating cycle. Timer $T_1$ counts a first pre-established time interval ($T_1$) longer than the time period required for a normal operating cycle, while timer $T_2$ counts a second pre-established time interval ($T_2$) longer than the time period ($T_1$). If switch $SW_1$ is actuated again before the lapsed time (t) has reached the first time interval ($T_1$), a normal operating cycle has been performed. If the first time interval ($T_1$) lapses before switch $SW_1$ is actuated, a jam has occurred. Timer $T_1$ generates a first control signal that is furnished the control system (control C), which actuates actuatable means, such as the solenoid controlling cylinder 13. Actuation of the solenoid again moves the selector 8 towards its forward limit stop position, while spring 15, upon de-energizing of the solenoid, moves the selector 8 towards its rest position. Thus, the solenoid and spring cooperate with each other to oscillate or move the selector 8 to-and-fro.

However, should the vibration conveyed to selector 8 not succeed in clearing the jam up after a predetermined lapse of time ($T_2$) counted by timer $T_2$, the timer $T_2$ generates a second signal that results in an alarm signal calling for the operator's direct action. The sequence shown in FIGS. 8a–8g, on the other hand, refers to the semiautomatic unjamming process, i.e. one which requires the operator's action; as we shall see later, however, this kind of unjamming does not require a manual action, but rather the operation of a pushbutton or similar device.

The semiautomatic unjamming device is generally required when the nails jam at some point half-way through slots 9 rather than at the mouth 9a of said slots, as illustrated hereinabove.

Looking at the example shown in FIGS. 8a–8g, after having started its cycle in the usual way (FIGS. 8a, 8b), selector 8 has reached—under the thrust of cylinder 13—its forward stroke limit stop position (FIG. 8-b) and the solenoid valve is de-energized, hence the selector is starting its backward stroke, as a result of the action of the return spring. Following the usual cycle, the nail under discussion crosses mouth 9a of corresponding slot 9 but, as indicated in FIG. 8-c it causes a jam-up at some point half-way through said slot, which in turn causes selector 8 to stop. At this stage, the device responds in the way described previously; some time after the stoppage, the automatic unjamming system enters operation and tries to cause selector 8 to vibrate. The excitation of the solenoid valve, however, isn't capable of shifting selector 8, which remains locked in that same position (FIG. 8-d) because with this kind of jamming, the nail under discussion cannot move backwards within slot 9, although the selector is stressed in that direction.

The above position remains unchanged (FIG. 8-*e*) because the selector cannot reach its forward stroke limit stop and the aforementioned solenoid valve is still excited. This situation lasts until timer $T_2$ signals that a predetermined time interval has elapsed and actuates an alarm signal, thus calling for the operator's action. The latter must simply operate a special reset pushbutton 35 (FIG. 8-*f*) by means of which the solenoid valve is de-energized and selector 8 is shifted towards its resting position by the return spring. The nail which caused the jam up does not prevent said motion (which occurs in the nail feed direction), hence the selector can reach its limit stop position (FIG. 8-*g*), thus unjamming the machine and enabling the nail under discussion to reach the area of utilization, after having crossed its respective hole 9*b*. The device can start operating again in its usual fashion until a new jam up occurs, in which case the aforementioned operations will be repeated.

Obviously, the pressure of cylinder 13 and the thrust of counter spring 15 must be limited in such a way that, should a jam up occur, the entire unjamming operation be carried out smoothly in accordance with the above description; also the selector should not be subjected to excessive stress designed to force it into the limit stop positions, since this might cause serious mechanical damage to the device.

As described above, also distributor 18 is actuated through a fluid dynamic unit. However, jam ups don't usually occur in this part of the charging device, because once the nails are beyond selector 8, all that they have to do is cross some simple ducts until they enter the utilization area: this is why the distributor is always regular in its motion and no further unjamming units are required. Also distributor 18, however, may be supplied with other unjamming units, like the ones described hereinabove, so as to meet the requirements of greater safety.

As far as the combination of the selector's and distributor's movements is concerned, this is programmed in accordance with currently known technology, in such a way that for every single full stroke of the distributor there be two full strokes of the selector; this enables the latter to charge—in two successive stages—both sets of passages 19, 20 of said distributor.

In the case of a device in accordance with this invention, said combination can be achieved by simply programming the feeding of cylinders 13 and 23 (FIGS. 2 and 3 respectively) in the correct sequence.

Besides exploiting a particularly simple and rational method for the operation of the selector and distributor, the device according to this invention allows, in most cases, for the achievement of a quick automatic unjamming, capable of preventing the nails from stopping the selector when they are fitted into the slots of same; the device, furthermore, provides for an efficient semiautomatic unjamming operation, which does not require any manual action in the jam up area, but just the operation of a pushbotton, when the nails tend to lock the selector in a certain position as they cross their respective slots.

Naturally the invention is not restricted to the embodiment described hereinabove, but may be subject to several variations and alterations, all of which are comprised within the scope of this invention. Thus, for instance, double-acting cylinders or electromagnetic control units may be employed instead of the aforementioned single-acting fluid dynamic cylinders. Or to quote another example, the device according to the invention may be applied to a different nail magazine from the one described herein.

What I claim is:

1. A nail delivery device for delivering nails from a rotating storage magazine to a plurality of passages, said device comprising:

a selector having slots extending therethrough, each slot having a mouth for receiving a nail to be delivered, and an outlet alignable with one of said passages;

guide means extending between the storage magazine and said selector for guiding passage of nails from the storage magazine to said selector;

actuatable means for moving said selector to-and-fro so as to move said slots from first positions in which the mouths of the slots are positioned for receiving nails from said guide means to second positions in which outlets of said slots are aligned with respective ones of said passages to thereby deliver nails to said passages;

control means for sensing to-and-fro movement of said selector and for generating a first signal when movement is not sensed within a first predetermined time period thereby providing an indication of jamming of said selector; and said actuatable means being responsive to said signal for oscillating said selector to thereby automatically unjam said selector.

2. A nail delivery device according to claim 1, wherein said control means further comprises means for generating a second signal when movement is not sensed within a second predetermined time period, the second predetermined time period being greater than the first predetermined time period, said second signal alerting an operator to perform an unjamming operation.

3. A nail delivery device according to claim 1 or 2, wherein said selector has an arm integral therewith and wherein said actuatable means comprises a fluid dynamic actuator having a cylinder with a stem in contact with a first surface of said arm, a block, and biassing means for urging said block into contact with a second surface of said arm, said first and said second surfaces being on opposite sides of said arm.

4. A nail delivery device according to claim 1 or claim 2, wherein said means for sensing comprises a sensor for sensing a limit stop position of said selector, and timing means for generating said first signal, said timing means being adjustable so that said first predetermined time period is longer than the time period normally needed for passage of a nail through said selector.

5. A nail delivery device according to claim 3, wherein said means for sensing comprises a sensor for sensing a limit stop position of said selector, and timing means for generating said first signal, said timing means being adjustable so that said first predetermined time period is longer than the time period normally needed for passage of a nail through said selector, said first signal periodically actuating said actuatable means to thereby oscillate said actuator.

6. In a nail delivery device comprising a rotating member containing a supply of nails to be delivered, a chute having an inlet section with a plurality of raceways for receiving nails from the rotating member, a plurality of guides receiving nails from said raceways, a reciprocatable comb-shaped selector having slots formed therein receiving nails from said guides one at a time, a reciprocatable distributor having passages formed therein receiving nails from said slots, and utilization outlets receiving nails from said passages, the improvement wherein:

said selector has an arm, a first fluid dynamic actuator acts on said arm to move said selector in a first direction to receive nails from said guides and to move said selector in a direction opposite said first direction to deliver received nails to said distributor, movement of said selector being stopped by jamming of a nail therein; and control means for sensing movement of said selector and for generating a first control signal when no movement is sensed within a first predetermined time period, said first fluid dynamic actuator being responsive to said first control signal to rapidly move said actuator to-and-fro to thereby automatically unjam the jammed nail.

7. A nail delivery device according to claim 6, wherein the improvement further comprises a second fluid dynamic actuator for moving said distributor between a first position receiving nails from said selector and a second position delivering nails to said utilization outlets.

8. A nail delivery device according to claim 6 or 7, wherein said control means includes means for generating a second signal when no movement is sensed within a second predetermined time period longer than said first predetermined time period.

9. A device according to claim 8, wherein said first fluid dynamic actuator comprises a cylinder having a stem contacting said arm of said selector, a block, and a return spring urging said block into contact with said arm of the selector, on the opposite side relative to the one operating in conjunction with said stem.

10. A device according to claim 8, wherein said second fluid dynamic actuator comprises a cylinder having a stem extending axially, the stem having a rod passing through a hole formed in an arm of the distributor, said rod having a free end provided with a piston sliding in a respective hole, said hole housing a counter spring; a spring wound round said rod between the piston and the arm of the distributor and a spring disposed between said arm and the stem of the cylinder of said second actuator.

11. A device according to claim 8, wherein said control means comprises a sensor for sensing a limit stop position of said selector, and a timer which is adjusted in such a way as to allow for normal nail feed through said selector within a predetermined time interval, said timer causing interval operation of said first actuator after said first predetermined time so as to produce a continuous oscillation of said selector, until the device is unjammed.

* * * * *